US008403463B2

(12) United States Patent
Martin et al.

(10) Patent No.: US 8,403,463 B2
(45) Date of Patent: Mar. 26, 2013

(54) CONTINUOUS STREAM INK JET PRINTHEAD

(75) Inventors: Graham D. Martin, Sawston (GB); Sukbir S. Pannu, Grantchester (GB); Nigel E. Sherman, Bury St Edmunds (GB)

(73) Assignee: Videojet Technologies Inc.

( * ) Notice: Subject to any disclaimer, the term of this patent is extended or adjusted under 35 U.S.C. 154(b) by 602 days.

(21) Appl. No.: 12/524,297

(22) PCT Filed: Jan. 23, 2008

(86) PCT No.: PCT/EP2008/050729

§ 371 (c)(1), (2), (4) Date: May 3, 2010

(87) PCT Pub. No.: WO2008/090164

PCT Pub. Date: Jul. 31, 2008

(65) Prior Publication Data

US 2010/0271441 A1 Oct. 28, 2010

(30) Foreign Application Priority Data

Jan. 23, 2007 (GB) ..... 0701233.9

(51) Int. Cl.
*B41J 2/07* (2006.01)

(52) U.S. Cl. ..... 347/74

(58) Field of Classification Search ..... 347/73–75, 347/77, 82, 89, 90, 34, 35
See application file for complete search history.

(56) References Cited

U.S. PATENT DOCUMENTS

| | | | | |
|---|---|---|---|---|
| 4,575,735 | A * | 3/1986 | Weinberg | 347/74 |
| 4,743,922 | A | 5/1988 | Regnault | |
| 4,800,398 | A | 1/1989 | Naruse | |
| 5,001,497 | A * | 3/1991 | Wills et al. | 347/82 |
| 5,142,297 | A * | 8/1992 | Eijkman et al. | 347/74 |
| 5,363,124 | A | 11/1994 | Arway | |
| 6,254,216 | B1 | 7/2001 | Arway | |
| 7,219,976 | B2 * | 5/2007 | Mori et al. | 347/76 |

OTHER PUBLICATIONS

Anonymous, "Alignment mechanism for ink jet printing system," Research Disclosure Journal, Jan. 1998, vol. 405, No. 55, Kenneth Mason Publications, Hampshire GB.

* cited by examiner

*Primary Examiner* — Kristal Feggins
(74) *Attorney, Agent, or Firm* — Joseph A. Yosick

(57) ABSTRACT

A continuous stream ink jet print head comprising: a droplet generator (1) for generating a continuous stream of ink droplets; a charging electrode (40) for selectively charging the ink droplets; deflection electrodes (4) for deflecting the charged ink droplets; and a catcher (7) for collecting uncharged ink droplets, wherein the deflection electrodes are contained within a surrounding structure (2) that both (i) provides surfaces (41) which are contoured to the shape of the main bodies of the deflection electrodes such that the main bodies may be mounted against the surfaces to correctly position the deflection electrodes within the print head, and (ii) serves as a manifold for fluid in operation of the print head, wherein the print head includes a cover (10) for the surrounding structure, the cover forming a wall of the space between the deflection electrodes, the wall extending along the stream of ink droplets.

4 Claims, 6 Drawing Sheets

CONTINUOUS STREAM INK JET PRINTHEAD

RELATED APPLICATIONS

This application claims priority under 35 U.S.C. §371 from PCT Application No. PCT/EP2008/050729, filed in English on Jan. 23, 2008, which claims the benefit of Great Britain Application Serial No. 0701233.9 filed on Jan. 23, 2007, the disclosures of which are incorporated by reference herein in their entireties The present invention relates to a continuous stream ink jet print head.

More particularly the present invention relates to a continuous stream ink jet print head comprising: a droplet generator for generating a continuous stream of ink droplets; a charging electrode for selectively charging the ink droplets; deflection electrodes for deflecting the charged ink droplets; and a catcher for collecting uncharged ink droplets.

One example of such a print head is disclosed in U.S. Pat. No. 6,254,216. This print head includes a cleaning system in which the charging and deflection electrodes are enclosed within a compartment. This has a number of problems: multiple exit ports are required to empty the compartment; the compartment needs to be completely filled; when cleaning the solvent is introduced through the nozzle so no backflush is possible; electrode alignment is still required; the compartment is open when the print head is not in operation allowing ingress of contamination; and the droplet generator and nozzle are left wet after cleaning which compromises restart after a long term shut down.

During operation, continuous stream ink jet print heads accumulate deposits of ink and other contamination that can eventually lead to poor performance or failure. In existing equipment it is required that an operator clean the print head from time to time. Often this has to take place prior to starting or following shut down. This manual operation can lead to inadequate cleaning and subsequent equipment unreliability. This process also takes time, must be carried out by a trained operator, and leads to mess and spills.

Previous attempts to automate the cleaning process have been cumbersome and slow, and have required large amounts of cleaning solvent to work properly. These systems have also not provided, in a single system, cleaning of the deflection electrode structures and the back flushing of the nozzle to provide optimum blockage removal. The present invention enables cleaning to take place quickly, with minimum solvent use, and enables the electrodes to be cleaned and the nozzle back flushed in an automatic operation requiring no skill on the part of the operator.

If, on shut down, the nozzle and droplet generator is wet with ink, then, over time, the ink will dry and leave a crust over or within the nozzle that can be difficult to remove. This can result in the printer not working when next required. Even when the nozzle and droplet generator have been cleaned but left wet with solvent, residual ink components left dissolved in the solvent can concentrate as the solvent dries leaving crusty deposits which can obstruct the nozzle. The present invention leaves the deflection electrodes, the nozzle and droplet generator substantially dry hence enabling a fast and reliable start up when next required.

Existing print head designs require that the component parts be aligned by the operator or service technician to enable optimum performance. This can lead to incorrect setting or accidental change of setting (for example during cleaning) resulting in poor performance and unreliability. The present invention enables components to be positioned during assembly without requiring alignment then or later.

Existing print heads, because of the need to mount and align components and provide access for cleaning, are physically extended in the printing direction, making it difficult to stack print heads for multi-line printing. The present invention enables the print head to be much smaller in the printing direction facilitating the use of several print heads together.

Although existing print heads are enclosed they still have an opening through which the printed droplets pass. When the printer is shut down, this opening can allow dirt, fibres, and other contamination to enter the print head, which can lead to poor performance and unreliability. Existing print heads either have no closure to the opening, a manual closure, or a closure that is open when the printer is not in operation. The present invention provides a compact, automatic closure that is closed when the printer is shut down, provides a seal during cleaning, and is only open when printing is taking place.

According to a first aspect of the present invention there is provided a continuous stream ink jet print head comprising: a droplet generator for generating a continuous stream of ink droplets; a charging electrode for selectively charging the ink droplets; deflection electrodes for deflecting the charged ink droplets; and a catcher for collecting uncharged ink droplets, wherein the deflection electrodes are contained within a surrounding structure that both (i) provides surfaces which are contoured to the shape of the main bodies of the deflection electrodes such that the main bodies may be mounted against the surfaces to correctly position the deflection electrodes within the print head, and (ii) serves as a manifold for fluid in operation of the print head, wherein the print head includes a cover for the surrounding structure, the cover forming a wall of the space between the deflection electrodes, the wall extending along the stream of ink droplets.

In a print head according to the preceding paragraph it is preferable that the charging electrode is also contained within the surrounding structure and the position of the charging electrode within the print head is predetermined by the shape of the structure.

In a print head according to either of the preceding two paragraphs it is preferable that the catcher is also contained within the surrounding structure and is formed integrally as a part of the structure.

In a print head according to any one of the preceding three paragraphs it is preferable that the droplet generator is mounted on the surrounding structure, and the print head further comprises an alignment mechanism whereby the generator can be aligned with respect to the structure.

In a print head according to the preceding paragraph the alignment mechanism may include an eccentric cam.

According to a second aspect of the present invention there is provided a method of cleaning a continuous stream ink jet print head comprising utilising an inlet to the print head to generate within the print head a spray of ink solvent that coats internal surfaces of the print head to dissolve ink deposits on these internal surfaces.

In a method according to the preceding paragraph it is preferable that the spray is generated by alternately supplying air and ink solvent to the inlet.

It is preferable that a method according to either of the preceding two paragraphs further comprises, following the step of generating a spray, supplying air to the print head to dry the internal surfaces of the print head.

In a method according to the preceding paragraph the air may be heated.

According to a third aspect of the present invention there is provided a continuous stream ink jet print head comprising: a droplet generator for generating a continuous stream of ink droplets; a charging electrode for selectively charging the ink droplets; deflection electrodes for deflecting the charged ink droplets; and a catcher for collecting uncharged ink droplets, wherein an inlet to the print head is provided by means of which ink solvent can be supplied to the print head so as to travel simultaneously (i) to the charging and deflection electrodes to dissolve ink deposits on these electrodes, and (ii) via the nozzle of the droplet generator to the interior of the generator to reverse flush the nozzle.

In a print head according to the preceding paragraph it is preferable that the charging and deflection electrodes are contained within a surrounding structure that serves as a manifold for fluid in operation of the print head, the droplet generator is mounted on the surrounding structure, and the inlet leads to a point between the droplet generator and the surrounding structure.

In a print head according to the preceding paragraph it is preferable that the catcher is also contained within the surrounding structure, and the surrounding structure includes a closable opening through which charged ink droplets pass to print, in cleaning of the print head the closable opening being closed and the ink solvent that travels to the charging and deflection electrodes leaving the print head via a return line from the catcher.

In a print head according to any one of the preceding three paragraphs it is preferable that the droplet generator includes an outlet there from, in cleaning of the print head the ink that travels to the interior of the generator leaving the generator via both the outlet and the normal ink inlet to the generator.

According to a fourth aspect of the present invention there is provided a mechanism for opening and closing an opening through which charged ink droplets pass to print in a continuous stream ink jet print head, the mechanism comprising a deflatable member positioned adjacent the opening which in its relaxed non-deflated state covers the opening so as to close the opening, and in its not relaxed deflated state uncovers the opening so as to open the opening.

It is preferable that a mechanism according to the preceding paragraph further comprise a rigid member disposed within the deflatable member, a portion of the rigid member being spaced from the deflatable member when the deflatable member is in its relaxed non-deflated state, the deflatable member deflating into the portion of the rigid member so as to open the opening through which charged ink droplets pass to print.

In a mechanism according to the preceding paragraph it is preferable that the deflatable member comprises a flexible tube, the rigid member comprises a rigid tube, the portion of the rigid member comprises an opening in the side of the rigid tube, and the flexible tube is deflated by extracting air from the rigid tube to draw the flexible tube into the opening in the side of the rigid tube.

According to a fifth aspect of the present invention there is provided a method of determining the cleanliness of a continuous stream ink jet print head comprising supplying ink solvent to the print head to dissolve ink deposits on internal surfaces of the print head, recovering the ink solvent from the print head, and measuring the conductivity of the recovered ink solvent to determine the cleanliness of the print head, the lower the conductivity of the recovered ink solvent the cleaner the print head.

According to a sixth aspect of the present invention there is provided a method of cleaning a continuous stream ink jet print head comprising supplying ink solvent to the print head to dissolve ink deposits on internal surfaces of the print head, recovering the ink solvent from the print head, measuring the conductivity of the recovered ink solvent, and terminating the supply of ink solvent to the print head when the conductivity of the recovered ink solvent drops to a predetermined level.

The invention will now be described, by way of example, with reference to the accompanying drawings, in which.

Figure 1:
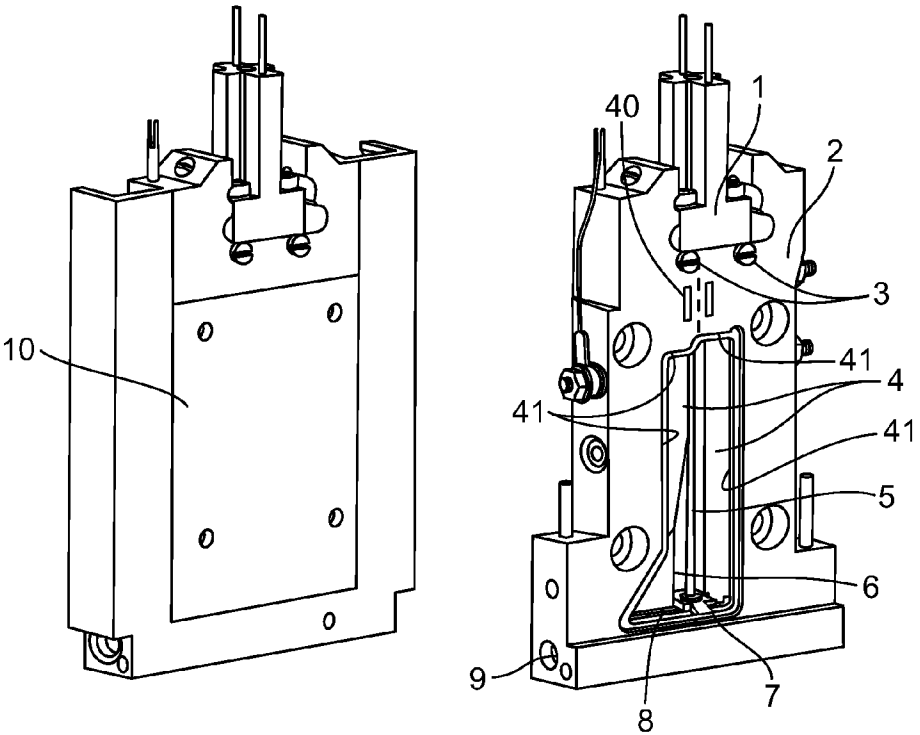
FIG. 1 shows a continuous stream ink jet print head in accordance with the present invention, with its cover on (left of Fig) and its cover off (right of Fig)

Referring to FIG. 1, the print head comprises a cover 10 and a main body 2. The main body 2 is made of a non-conductive material, e.g. the plastic polyetheretherketone, which is moulded and/or machined to make a one-piece fluid manifold and framework for positioning the charging electrode 40 and deflection electrodes 4. Note, although the charging electrode 40 is shown in FIG. 1 (in schematic) it is in fact hidden behind the casing of main body 2. The main body 2 also incorporates as part of its structure the catcher 7. The main body 2 also has a means to attach and align a droplet generator 1 that seals onto the main body 2.

This structure means that the cavity 6, within which the droplets form and are deflected for printing, is contained within the structure and only requires one cover 10 to complete the seal once assembly of the deflection electrodes 4 into the part has been completed. The positions of the charge and deflection electrodes are predetermined by the shape of the main body 2. With regard to the deflection electrodes 4, the structure provides surfaces 41 which are contoured to the shape of the main bodies of the electrodes such that the main bodies may be mounted against the surfaces 41 to correctly position the electrodes within the print head. Thus, the component acts as both a means to hold and locate the electrodes and as a manifold for the fluids. These things in combination allow the dimension in the print direction to be smaller than in prior art designs, with the advantage that several print heads can be easily stacked together.

Figure 2:
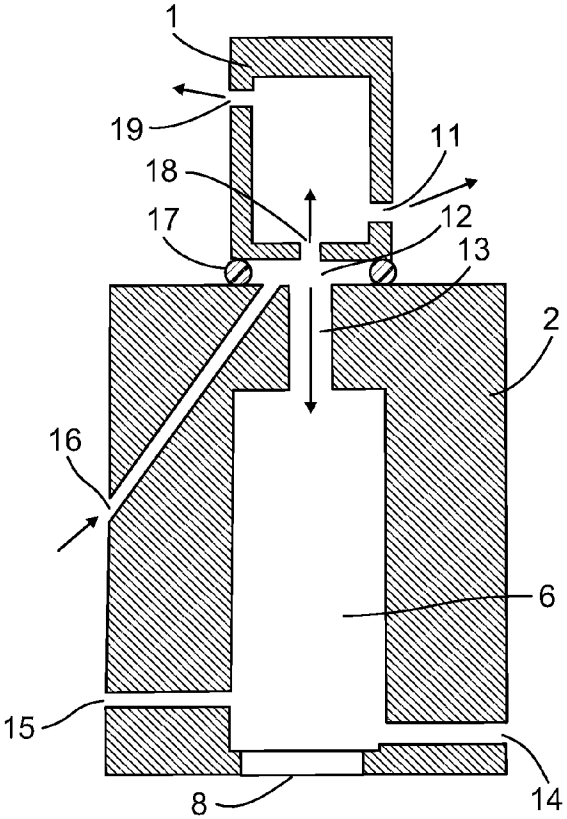
FIG. 2 illustrates schematically fluid flow through the print head of FIG. 1 during cleaning of the print head.

Referring also to FIG. 2, droplet generator 1 is sealed against main body 2 using a compliant material component 17 such as a rubber O-ring. During normal operation, ink is forced under pressure from the droplet generator 1, through the nozzle 18 to form a jet 5 (see FIG. 1) that breaks up into ink droplets within the charge electrode tunnel 13. Uncharged droplets are collected by the catcher 7 (not shown in FIG. 2) and returned to the ink system via the catcher return tube 14. Charged droplets are deflected by the field between the deflector plates 4 (also not shown in FIG. 2) and emerge to be printed through the open closure 8. An air flow through a separate port 15 maintains a slight positive pressure within the deflection cavity 6 to ensure no contamination is drawn in through the open closure 8.

When a shut down or cleaning cycle is initiated the closure 8 is closed and the ink supply valve (see later) is also closed.

Then fluid is introduced through inlet 16 so that it washes the volume 12 between the nozzle 18 and the charge electrode tunnel 13. At the same time fluid is drawn out of the droplet generator 1 through an outlet 11 and also through what is normally the ink inlet 19. Wash fluid enters the deflection cavity 6 through the charge electrode tunnel 13, and exits via the catcher return tube 14. Thus, fluid flows in the directions indicated by the arrows, back flushing the droplet generator and cleaning the deflection cavity. As can be seen this also cleans both the nozzle and the charge electrode.

The cleaning cycle is arranged so that dried ink and other contamination is removed by an agitated mixture of air and solvent that is flowing through the deflection cavity 6 and droplet generator 1. When these volumes are clean then air alone is flowed through the cavities to remove the remaining solvent and dry the cavities. It can be an advantage to use heated air or to heat at least part of the body or electrodes to accelerate this process.

Figure 3:
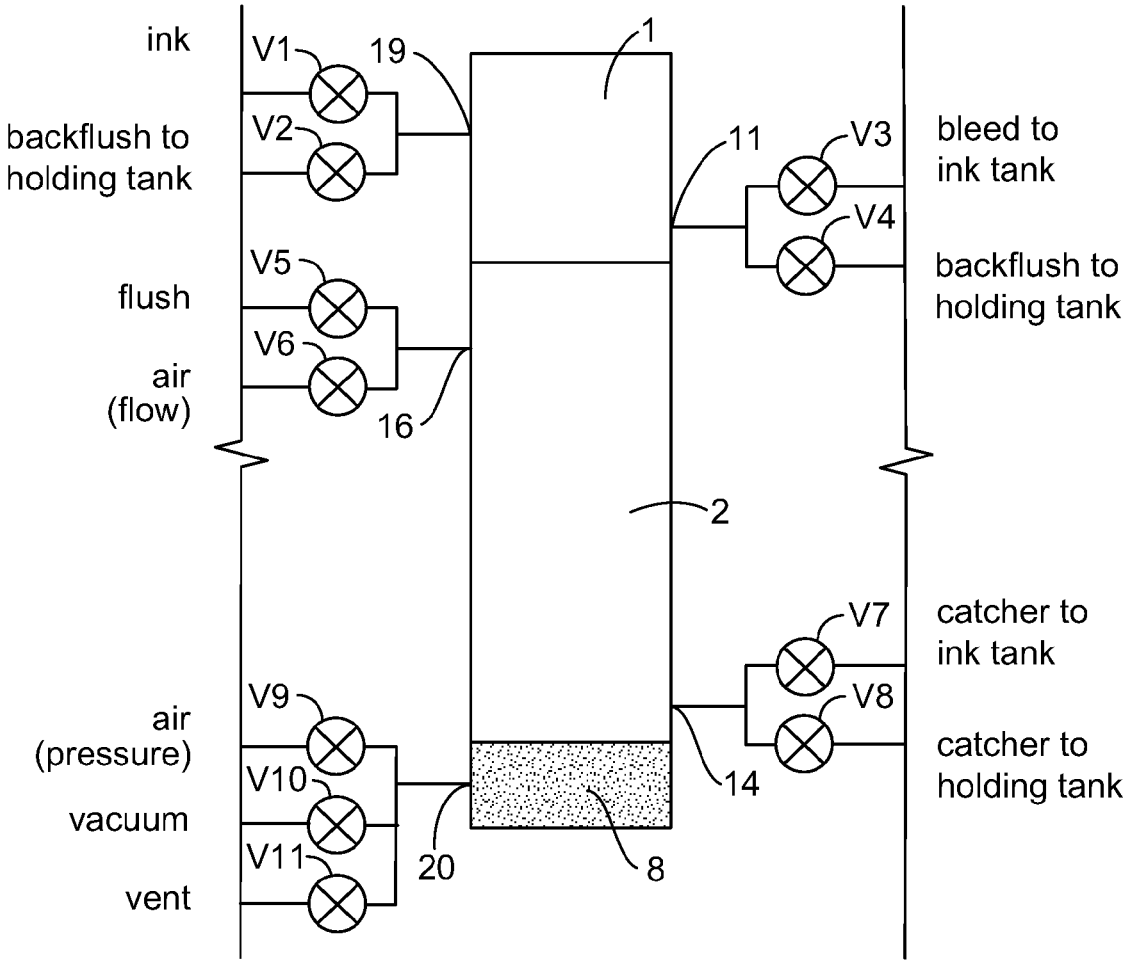
FIG. 3 shows a valve arrangement for supplying fluid to and receiving fluid from the print head of FIG. 1.

Referring also to FIG. 3, valves V1 to V11 control the supply of fluid to and the receipt of fluid from the print head. There are five entry/exit points to the print head: droplet generator ink in 19, droplet generator fluid out 11, print head body fluid in 16, ink return 14, and closure actuation 20. It is to be noted that control of the supply of air to the print head via port 15 (see FIG. 2) is not shown.

It has been discovered that a rapid interleaving of air and solvent produces a spray that coats all the surfaces within the deflection cavity and cleans it without requiring that the cavity is completely filled with solvent. This flow also ensures that the solvent is removed no matter what the orientation of the print head without the need for multiple drainage lines which would be required if the volumes were drained under gravity.

Figure 4:
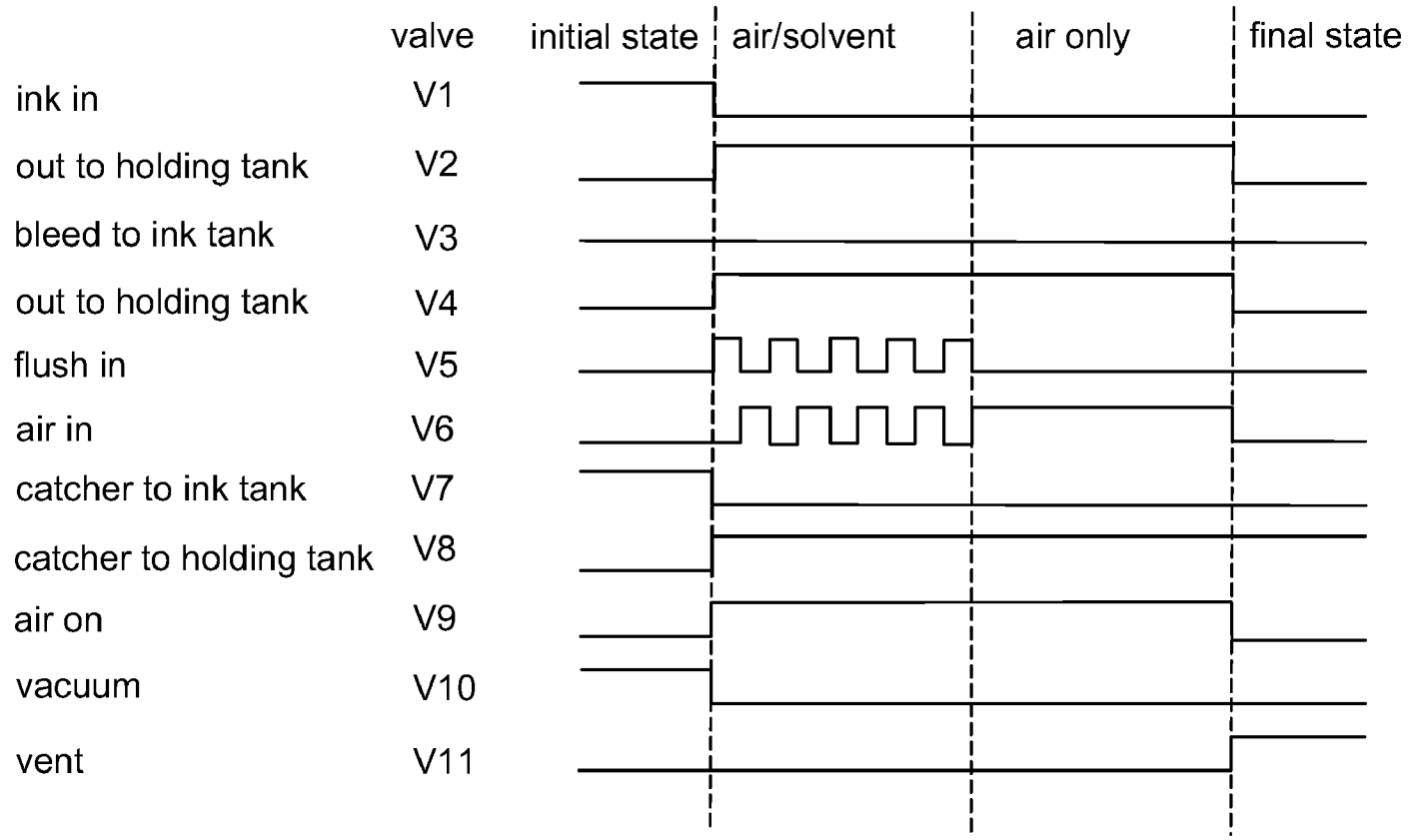
FIG. 4 is a valve state diagram illustrating a shut down sequence of the print head of FIG. 1.
Figure 5:
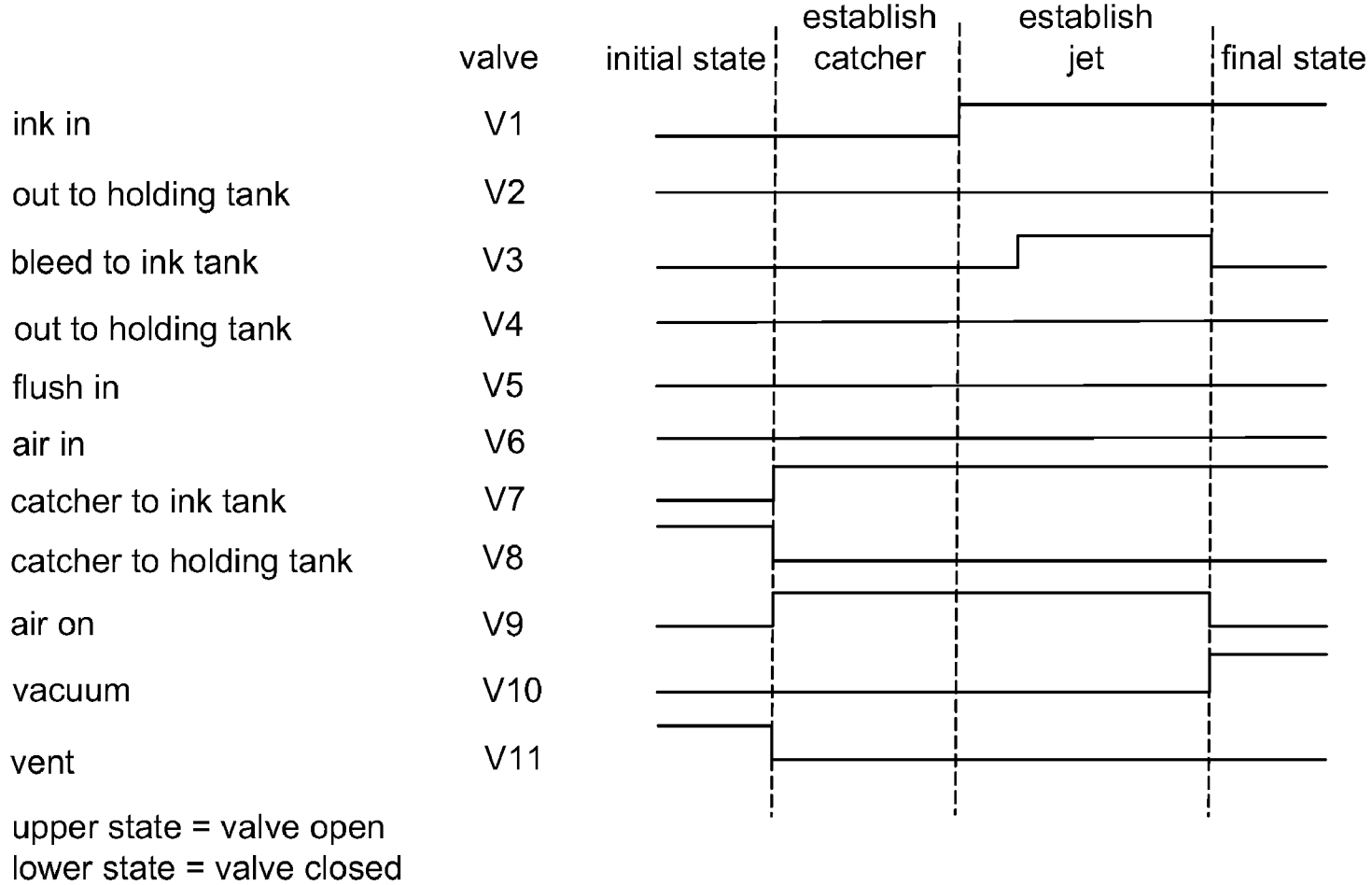
FIG. 5 is a valve state diagram illustrating a start up sequence of the print head of FIG. 1.

Regard is now also to be had to FIGS. 4 and 5, which are self explanatory. The valve numbers in FIGS. 4 and 5 correspond to the valves shown in FIG. 3.

Figure 6A:
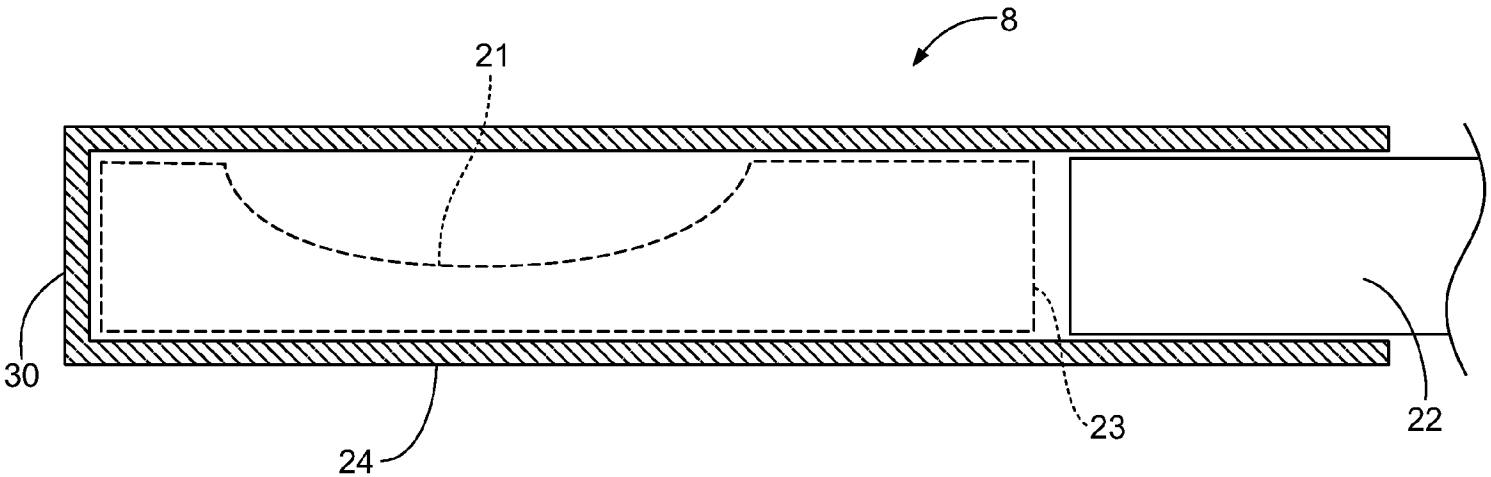
FIGS. 6A and 6B illustrate a mechanism for opening and closing an opening of the print head of FIG. 1 through which charged ink droplets pass to print.
Figure 6B:
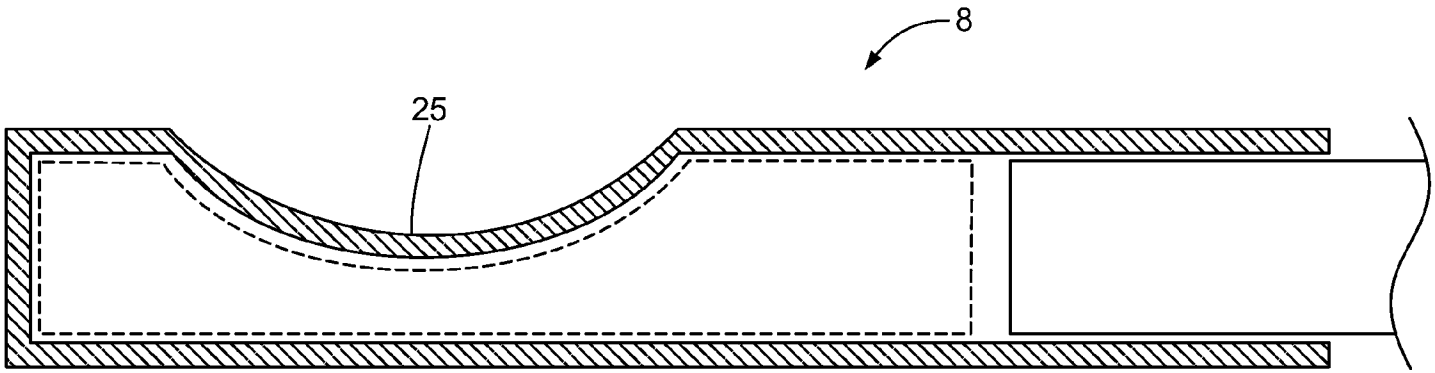

Referring also to FIGS. 6A and 6B, FIG. 6A shows the mechanism 8 in the closed position, and FIG. 6B the mechanism 8 in the open position. A flexible tube 24 covers a rigid tube 23 that has an opening 21. The flexible tube has a closed end 30. The flexible tube is connected by a pipe 22 to sources of vacuum and pressure.

The mechanism is inserted into a bore 9 in the main body 2 (see FIG. 1) such that the flexible tube 24 when in a relaxed state (FIG. 6A) closes the slot of the print head through which printed droplets emerge. The opening 21 is positioned so that when a vacuum is applied the flexible tube 24 is drawn into the opening 21, see 25, thus opening the slot and allowing printed droplets to emerge from the print head. Hence, when the print head is off, the mechanism 8 is shut ensuring no contamination or particulates can get into the electrode cavity. During the cleaning cycle, when solvent is being agitated within the electrode cavity, the seal of mechanism 8 can be improved by applying a pressure to the flexible tube 24 forcing it against the inside wall of the slot.

A mechanism for aligning the droplet generator 1 is required to ensure that the jet 5 is sufficiently well positioned in the catcher 7 to ensure all printed droplets are printed and unprinted droplets captured. Because alignment is more critical across the edge of the catcher 7 only adjustment in this direction is required as the jet directionality is accurate enough in the other direction.

Figure 7:
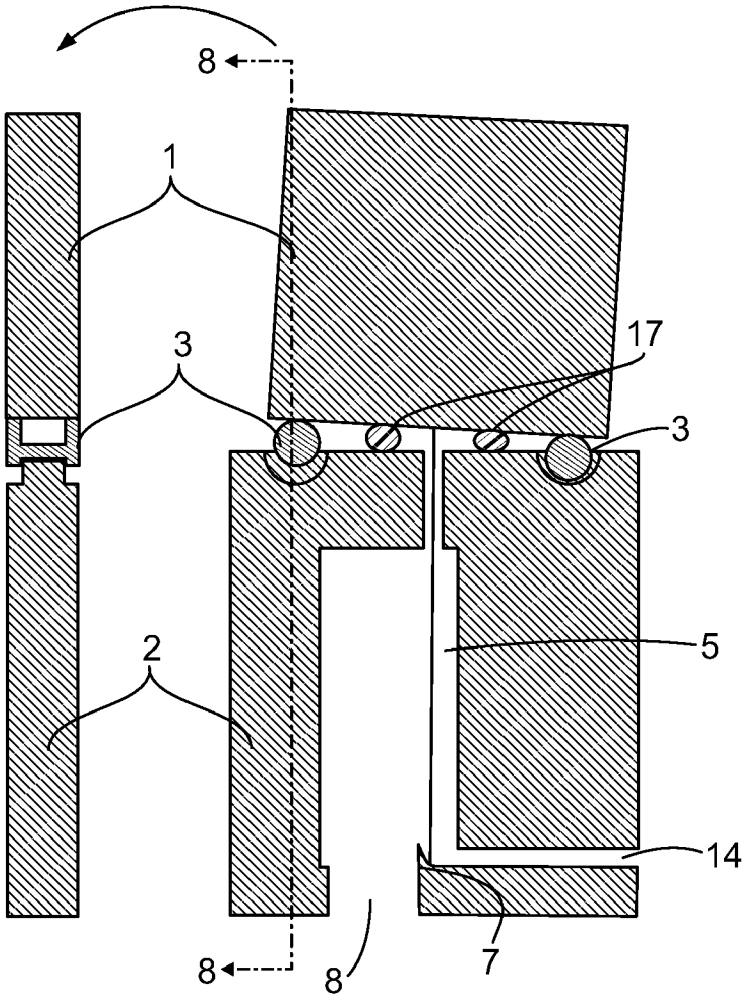
FIG. 7 illustrates alignment of a droplet generator of the print head of FIG. 1 with respect to the remainder of the print head.

Referring also to FIG. 7, the angle between the droplet generator 1 and the main body 2 is adjusted using two eccentric cams 3. O-ring 17 ensures that the area between the two parts remains sealed from the exterior. Alternatively, one cam can be replaced by a fixed ridge and all adjustments made with the remaining cam. This mechanism ensures the jet 5 meets the catcher 7 at the correct point even if it does not emerge exactly perpendicular to the face of nozzle 18 (see FIG. 2).

If the print head is not very dirty or contaminated then the cleaning cycle could be terminated more quickly saving time and solvent. It has been discovered that the cleanliness of the fluid drawn from the print head while cleaning is related to its conductivity. Ink has a characteristic conductivity, pure solvent is non-conductive, a mixture something in between. Thus, as the cleaning solvent drawn from the print head during cleaning gets cleaner its conductivity reduces.

Figure 8:
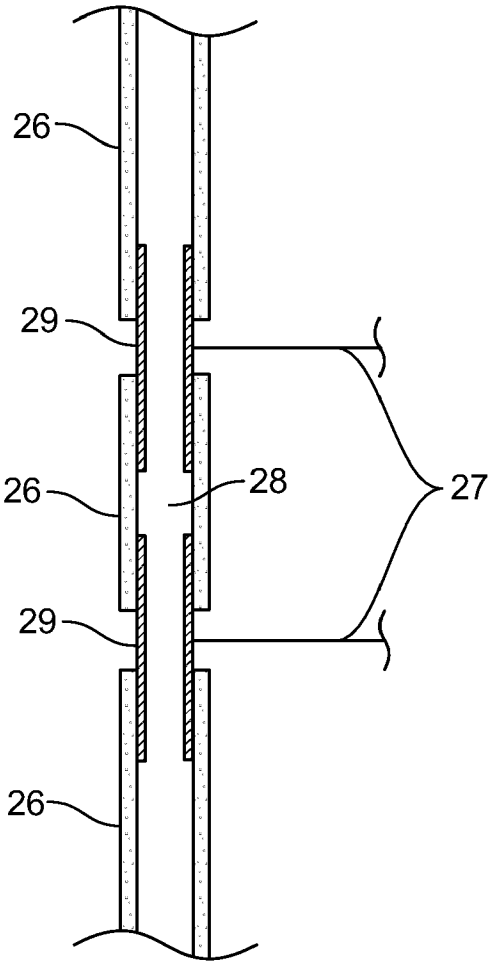
FIG. 8 illustrates a sensor for measuring the cleanliness of ink solvent used to clean the print head of FIG. 1.

Referring also to FIG. 8, the sensor shown can be part of the catcher fluid return line 14 (see FIGS. 2, 3 and 7). Two metal tubes 29 are inserted in the non-conductive catcher return tube 26 such that there is a small gap 28 separating the two metal tubes 29. By making electrical connections 27 to the metal tubes 29 the conductivity of the fluid within the gap 28 can be measured to determine the cleanliness of the solvent return during cleaning. This sensor could also be used to detect the presence of ink in the return line for fault diagnostics.

The invention claimed is:

1. A continuous stream ink jet print head comprising: a droplet generator for generating a continuous stream of ink droplets; a charging electrode for selectively charging the ink droplets; deflection electrodes for deflecting the charged ink droplets; and a catcher for collecting uncharged ink droplets, wherein an inlet to the print head is provided by means of which ink solvent can be supplied to the print head so as to travel simultaneously (i) to the charging and deflection electrodes to dissolve ink deposits on these electrodes, and (ii) via the nozzle of the droplet generator to the interior of the generator to reverse flush the nozzle.

2. A print head according to claim 1 wherein the charging and deflection electrodes are contained within a surrounding structure that serves as a manifold for fluid in operation of the print head, the droplet generator is mounted on the surrounding structure, and the inlet leads to a point between the droplet generator and the surrounding structure.

3. A print head according to claim 2 wherein the catcher is also contained within the surrounding structure, and the surrounding structure includes a closable opening through which charged ink droplets pass to print, in cleaning of the print head the closable opening being closed and the ink solvent that travels to the charging and deflection electrodes leaving the print head via a return line from the catcher.

4. A print head according to claim 1 wherein the droplet generator includes an outlet there from, in cleaning of the print head the ink that travels to the interior of the generator leaving the generator via both the outlet and the normal ink inlet to the generator.

* * * * *